US008978884B1

(12) United States Patent
Kushner

(10) Patent No.: US 8,978,884 B1
(45) Date of Patent: Mar. 17, 2015

(54) AUTOMATIC MUSICAL INSTRUMENT NECK SUPPORT IN HYBRID CASES

(76) Inventor: Daniel Watson Kushner, San Rafael, CA (US)

( * ) Notice: Subject to any disclaimer, the term of this patent is extended or adjusted under 35 U.S.C. 154(b) by 82 days.

(21) Appl. No.: 13/611,216

(22) Filed: Sep. 12, 2012

Related U.S. Application Data

(60) Provisional application No. 61/557,896, filed on Nov. 9, 2011, provisional application No. 61/587,896, filed on Jan. 18, 2012, provisional application No. 61/587,363, filed on Jan. 17, 2012.

(51) Int. Cl.
*A45C 11/00* (2006.01)
*G10G 7/00* (2006.01)

(52) U.S. Cl.
CPC ..... *G10G 7/005* (2013.01)
USPC ..... 206/314

(58) Field of Classification Search
USPC ..... 206/314, 14, 477, 478, 480; 190/109, 190/111
See application file for complete search history.

(56) References Cited

U.S. PATENT DOCUMENTS

| | | | | |
|---|---|---|---|---|
| 2,094,186 A | | 9/1937 | Patrick | 206/315.4 |
| 2,197,275 A | * | 4/1940 | Meyers | 206/314 |
| 2,351,673 A | * | 6/1944 | Erikson | 206/314 |
| 3,000,417 A | | 9/1961 | Goldstein | 206/5 |
| 3,530,919 A | | 9/1970 | May | 206/315.4 |
| 3,877,501 A | | 4/1975 | Toth | 150/52 |
| 3,901,384 A | | 8/1975 | Lee et al. | 206/314 |
| 4,065,995 A | | 1/1978 | Greer | 84/465 |
| 4,190,152 A | | 2/1980 | Reiter | 206/314 |
| 4,531,632 A | | 7/1985 | Weber | 206/14 |
| 4,659,000 A | | 4/1987 | Sales et al. | 224/252 |
| 4,738,340 A | | 4/1988 | Crespi | 190/18 |
| 4,778,136 A | | 10/1988 | Reimers | 248/96 |
| 4,795,030 A | | 1/1989 | Boyce | 206/314 |
| 4,846,340 A | | 7/1989 | Walther | 206/14 |
| 5,441,134 A | | 8/1995 | Carson | 190/111 |
| 5,713,465 A | * | 2/1998 | Choe | 206/314 |
| 5,833,051 A | | 11/1998 | Tiefenbrun et al. | 206/14 |
| 6,000,509 A | | 12/1999 | Chisholm | 190/109 |

(Continued)

FOREIGN PATENT DOCUMENTS

| | | |
|---|---|---|
| DE | 20114494 U1 | 2/2002 |
| GB | 2169586 | 7/1986 |
| JP | 2002366143 A | 12/2002 |

OTHER PUBLICATIONS

Incase Dub Bag, author unknown, printed Aug. 7, 2009, 7 pages from website with URL http://www.goincase.com/products/detail/dub-bag-cl56066.

(Continued)

*Primary Examiner* — Jacob K Ackun
(74) *Attorney, Agent, or Firm* — The Patent Source

(57) ABSTRACT

Hybrid cases for musical instruments are disclosed. The cases have a semi-rigid back, a semi-rigid sidewall, a semi-rigid cover hingedly connected to selectively enclose a region of space when releaseably fastened closed, and a multi-part neck-brace. The neck-brace has a semi-rigid neck-support with a top surface that supports the instrument neck and a neck-clamp opposing the neck-support and affixed to the cover such that the instrument neck is automatically secured between the top surface of the neck-support and the neck-clamp upon fastening the cover closed and without the use of a neck-brace retaining band.

13 Claims, 6 Drawing Sheets

(56) References Cited

U.S. PATENT DOCUMENTS

| | | | | |
|---|---|---|---|---|
| 6,029,804 | A | 2/2000 | Flynn | 206/14 |
| 6,126,012 | A | 10/2000 | Roegner | 206/579 |
| 6,172,292 | B1 | 1/2001 | Dimbath | 84/453 |
| 6,283,287 | B1 | 9/2001 | Carl | 206/314 |
| 6,441,288 | B1 | 8/2002 | Lin | 84/453 |
| 6,462,260 | B2 | 10/2002 | Fediakov | 84/327 |
| 6,499,592 | B2 | 12/2002 | Wilfer | 206/314 |
| 6,505,762 | B2 | 1/2003 | Wilfer | 224/153 |
| 6,670,536 | B2 | 12/2003 | Godin et al. | 84/453 |
| D487,627 | S | 3/2004 | Izen et al. | D3/204 |
| 6,727,415 | B1 | 4/2004 | Herring | 84/411 |
| 6,959,810 | B2 | 11/2005 | Neilson | 206/314 |
| 7,208,666 | B2 | 4/2007 | Burch | 84/327 |
| 7,687,701 | B1 | 3/2010 | Kushner | 84/453 |
| 7,712,608 | B2 | 5/2010 | Leach | 206/314 |
| 7,971,712 | B2 * | 7/2011 | Talwar et al. | 206/314 |
| 8,113,342 | B2 * | 2/2012 | Sonoda et al. | 206/14 |
| 8,141,703 | B2 * | 3/2012 | Sonoda et al. | 206/314 |
| 8,212,134 | B2 | 7/2012 | Kushner | 84/453 |
| 2003/0066770 | A1 | 4/2003 | Heesch | 206/314 |
| 2006/0042975 | A1 * | 3/2006 | Izen et al. | 206/314 |
| 2006/0230905 | A1 | 10/2006 | Stanley | 84/328 |
| 2007/0204742 | A1 | 9/2007 | Wilkerson | 84/329 |
| 2008/0060956 | A1 | 3/2008 | Izen et al. | 206/314 |
| 2008/0264745 | A1 | 10/2008 | Tauchen | 190/111 |
| 2010/0059409 | A1 | 3/2010 | Crowder | 206/757 |
| 2010/0252464 | A1 | 10/2010 | Belitz | 206/314 |
| 2010/0270187 | A1 * | 10/2010 | Sonoda et al. | 206/314 |
| 2011/0203952 | A1 | 8/2011 | Loban | 206/314 |

OTHER PUBLICATIONS

Attitude Double Guitar Bag GAV-EG30, author unknown, printed Aug. 7, 2009, 2 pages from website with URL http://www.rondomusic.com/gaveg30.html.

Undercover Double Gig Bags, author unknown, printed Aug. 7, 2009, 5 pages from website with URL http://www.bassexchange.com/catalog/index.php?cPath=38_159.

IKA double guitar case, author unknown, printed Aug. 7, 2009, 2 pages from website with URL http://www.ika.zrns.cz/img-new/guitdb.jpg.

Incase Dub Bag, author unknown, printed Apr. 11, 2009, 2 pages from website with URL http://www.goincase.com/products/detail/dub-bag-cl56066.

Gator Double Bass Guitar Slinger Gig Bag (G-Sling-2X-Bass), author unknown, printed Aug. 7, 2009, 1 page from website with URL http://www.interstatemusic.com/webapp/wcs/stores/servlet/ProductDisplay?storeId=10051&langId=-1&catalogId=10001&productId=900228619#.

ProTec CF233D—Deluxe Double Bass Guitar Gig Bag, author unknown, printed Aug. 7, 2009, 5 pages from website with URL http://www.casesandmore.com/PRO-TEC-CF233D-PRO1083.html.

Image Allow Cases: double guitar case, author unknown, printed Aug. 7, 2009, 1 page from website with URL http://www.imageallloycases.com.au/alum_av2.html?pid=23.

Mono, Wingman Case; Daniel Kushner, admitted prior art, 2 pages from website with URL http://www.monocase.com/store/pc/Wingman-Acoustic-Guitar-Case-Dreadnought-5p9.htm.

Mono, Wingman Case; Daniel Kushner, admitted prior art, 3 pages from website with URL http://www.monocase.com/mono-electric-guitar.asp.

Taobao, Soldier Case; author unknown, printed Nov. 30, 2010, 12 pages from unknown website URL.

Access, Stage Five Case; author unknown, date unknown, 2 pages from website with URL http://www.accessbagsandcases.com/gallery4.htm.

Suhr, Deluxe Case; author unknown, date unknown, 3 pages from website with URL http://www.suhrguitars.com/store.html.

Igig, G515 Case; author unknown, date unknown, 4 pages from website with URL http://www.mikobass.com/iGig/G515.htm.

Reunion Blues Continental Case; author unknown, date unknown, 3 pages from website with URL http://www.musiciansfriend.com/accessories/reunion-blues-rb-continental-electric-guitar-case.

Levy's Leather, Cps7 Case; author unknown, dated 2009, 3 pages from website with URL http://www.levysleathers.com/browse;cat,780;Pro-Series-Gig-Bags.

Fusion, F1 Dreadnaught Case; author unknown, printed Mar. 25, 2011, 2 pages from website with URL http://www.fusion-bags.com/products-in-guitar-gig-bags/f1-acoustic-dreadnought-guitar-orange-16119.

Images of guitar case, admitted prior art, author unknown, 2 pages from website with URL http://orgs.usd.edu/nmm/PluckedStrings/Guitars/Gibson/10075/StyleOGuitar.html.

Miscellaneous images of shoes and/or sneakers, admitted prior art, authors unknown, 4 pages.

PCT Application PCT/US12/00548, International Search Report . . . and Written Opinion of the International Searching Authority, mailed Mar. 7, 2013; 8 pages total.

PCT Application PCT/US12/00548, Preliminary Examination Report, etc., mailed Mar. 6, 2014; 11 pages total.

* cited by examiner

AUTOMATIC MUSICAL INSTRUMENT NECK SUPPORT IN HYBRID CASES

CROSS REFERENCE TO RELATED CASES

This application claims the benefit under 35 U.S.C. 119(e) of the following U.S. Applications: U.S. Application Ser. No. 61/557,896 filed Nov. 9, 2011 and entitled "Upright Access Of Hybrid Cases For Protecting Musical Instruments"; U.S. Application Ser. No. 61/587,896 filed Jan. 18, 2012 entitled "Musical Instrument Neck Support In Hybrid Cases"; and U.S. Application Ser. No. 61/587,363, filed Jan. 17, 2012 and entitled "Upright Access Of Hybrid Cases For Protecting Musical Instruments"; which applications are all hereby incorporated by reference in their entirety.

BACKGROUND OF THE INVENTION

1. Field of the Invention

The present invention is directed to hybrid cases for the protection of musical instruments. More particularly, the invention relates improvements in hybrid cases that employ an automatic neck-brace to support the neck of one or more musical instruments. Accordingly, the general objects of the invention are to provide novel methods and apparatus of such character.

2. Description of the Related Art

The worldwide popularity of instruments such as guitars, keytars, basses, cellos, violins, mandolins, ukuleles, etc. in the last several decades has led to many advances in these instruments as well as related accessories. One such accessory that has seen a wide variety of improvements is the protective case. Such cases are now available in a number of basic styles with a wide variety of materials and features that offer some combination of improved ergonomics, lower cost, lighter weight, and/or better protection. For example, instrument cases are now available in three basic styles (the soft case—or gig-bag—, the hard-shell case and the hybrid case). Cases for protecting individual instruments are now widely available in all of these three styles.

Conventional hybrid cases of the type noted-above typically include a semi-rigid body with a back, a sidewall and a hinged cover to receive the instrument within the body. Such covers may be releaseably mated with the body with latches, zippers, hook and loop fasteners, etc. and hinged such that the entire body/sidewall is exposed when the cover is in an opened position.

Such cases may include a semi-rigid neck-brace with at least one retaining band spanning from one side of the neck-brace to the other that may be used to releaseably secure the instrument neck to the neck-brace. The chance of instrument damage may be reduced in the event of a sideways or backward fall, in at least part, because the neck-brace and retaining band suspends the headstock between the bottom, sidewall and cover of the case and thereby prevents it from making contact. Related art (not necessarily prior art) examples of such neck-brace/retaining band designs are shown and described in U.S. Pat. No. 7,872,187 issued Jan. 18, 2011 and entitled Hybrid Cases For The Protection Of Up To Two Stringed Musical Instruments; and U.S. Pat. No. 7,687,701 and issued on Mar. 30, 2010 and entitled Cases For The Protection Of Stringed Musical Instruments, both of which patents are hereby incorporated by reference in their entirety. However beneficial and commercially successful such neck-brace/retaining band designs, some limitations are inherent in such designs.

It is therefore, a primary object of the present invention to provide improvements in carrying cases for stringed musical instruments which overcome the disadvantages associated with earlier types of hybrid cases.

SUMMARY OF THE INVENTION

The present invention satisfies the above-stated needs and overcomes the above-stated and other deficiencies of the related art by providing hybrid protective cases that have a semi-rigid back, a semi-rigid sidewall, a semi-rigid cover hingedly connected to selectively enclose a region of space when closed, and a multi-part neck-brace. The neck-brace may have a semi-rigid neck-support with a top surface that supports the instrument neck and a neck-clamp opposing the neck-support and affixed to the cover such that the instrument neck is releaseably secured to the top surface of the neck-support upon fastening the cover closed.

In a related form, the invention provides hybrid protective cases in which insertion of and removal of the musical instrument occurs with the case in an upright orientation. Such hybrid cases may have a semi-rigid body with an elongated upper access portion for receiving the instrument neck and a lower enveloping portion for receiving the instrument body. The upper access portion may have a back, at least one sidewall, and a cover a cover hingedly attached to the case body to selectively access to the upper access portion of the case body. The cases may also have a multi-part neck-brace having at least one semi-rigid neck-support with a top surface, the neck-support being affixed to the back such that the top surface of the neck-support supports the instrument neck. The neck-brace may also have at least one rigid neck-clamp opposing the neck-support and affixed to the cover such that the instrument neck is automatically secured to the top surface of the first neck-support upon fastening the cover closed.

In a preferred form, the inventive neck-brace may have a semi-rigid neck-support that has a unitary body elongated along an axis, that has a neck-contour-recess that is elongated along the axis and that has a pair of tapered shoulders that are elongated parallel to the axis and on opposites sides of the axis relative to one another. The inventive neck-brace may also have an opposing neck-clamp that is more rigid than the neck support body. The neck clamp may have a pair of tapered walls that are elongated parallel to the axis and on opposites sides of the axis relative to one another such that the tapered walls mate with the tapered shoulders of the neck-support to thereby secure the instrument neck between the neck-support and the neck-clamp.

In this way, the present invention disposes with the need for a neck-brace strap as used in the related art. This difference makes it easier to place an instrument into and remove an instrument from an inventive hybrid case compared with hybrid cases of the related art. The invention, although compatible with many styles of hybrid cases, is particularly well suited for use in hybrid cases designed to receive and/or remove an instrument in a vertical or upright orientation. This is because it has been discovered that the neck-brace straps (retaining bands) of the related art are unwieldy when strapping an instrument into a case in an upright orientation. Thus, inventive cases permit unparallel speed, convenience and reliable securing of instruments therein simply by closing the case cover and fastening the cover closed.

Numerous other advantages and features of the present invention will become apparent to those of ordinary skill in the art from the following detailed description of the preferred embodiments, from the claims and from the accompanying drawings.

BRIEF DESCRIPTION OF THE DRAWINGS

The preferred embodiments of the present invention will be described below with reference to the accompanying drawings where like numerals represent like steps and/or structures and wherein.

DETAILED DESCRIPTION OF THE PREFERRED EMBODIMENTS

Figure 1:
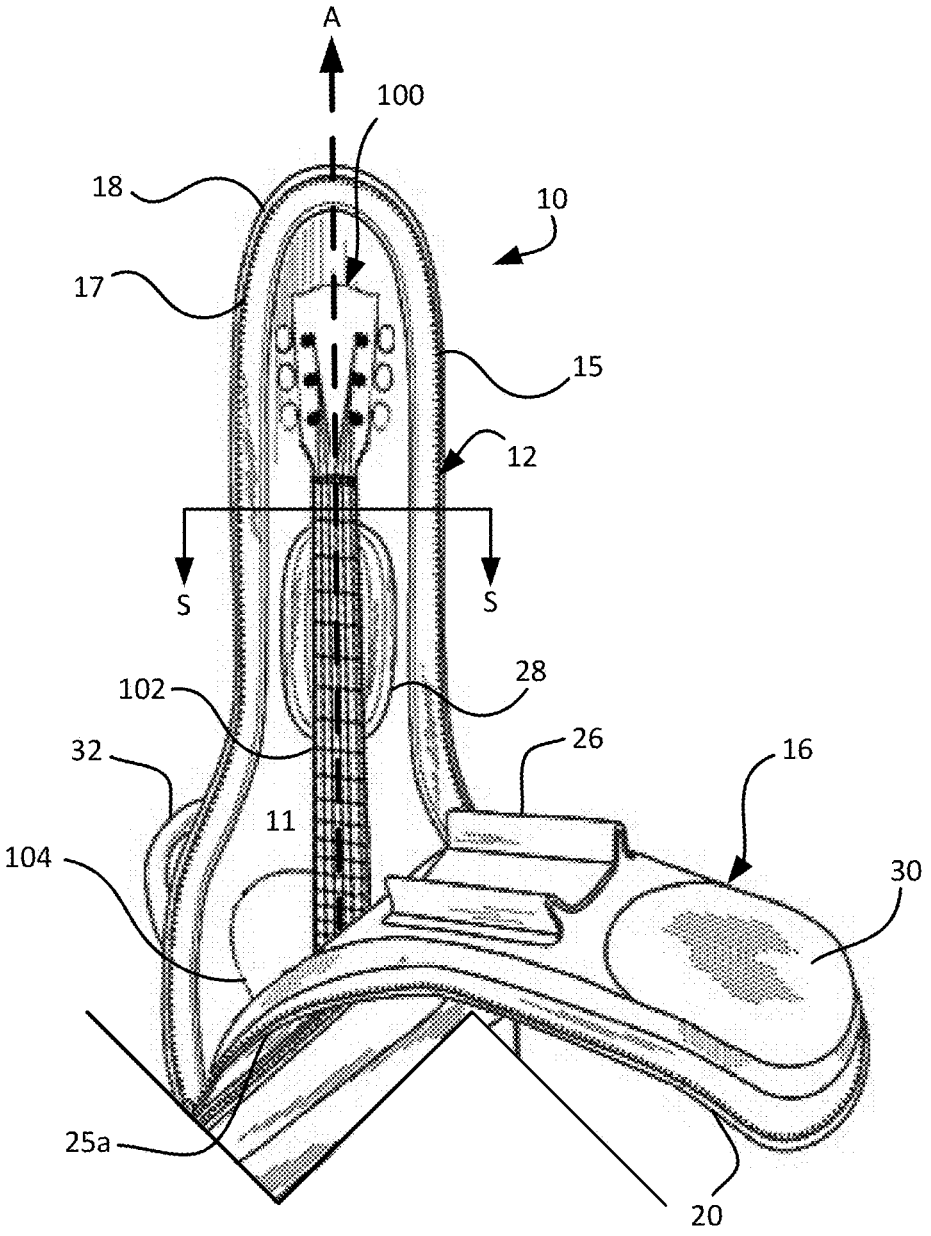
FIG. 1 is a partial front elevation view of a protective hybrid case (with an instrument having been inserted therein) in accordance with one preferred embodiment of the present invention shown in an opened condition.
Figure 2:
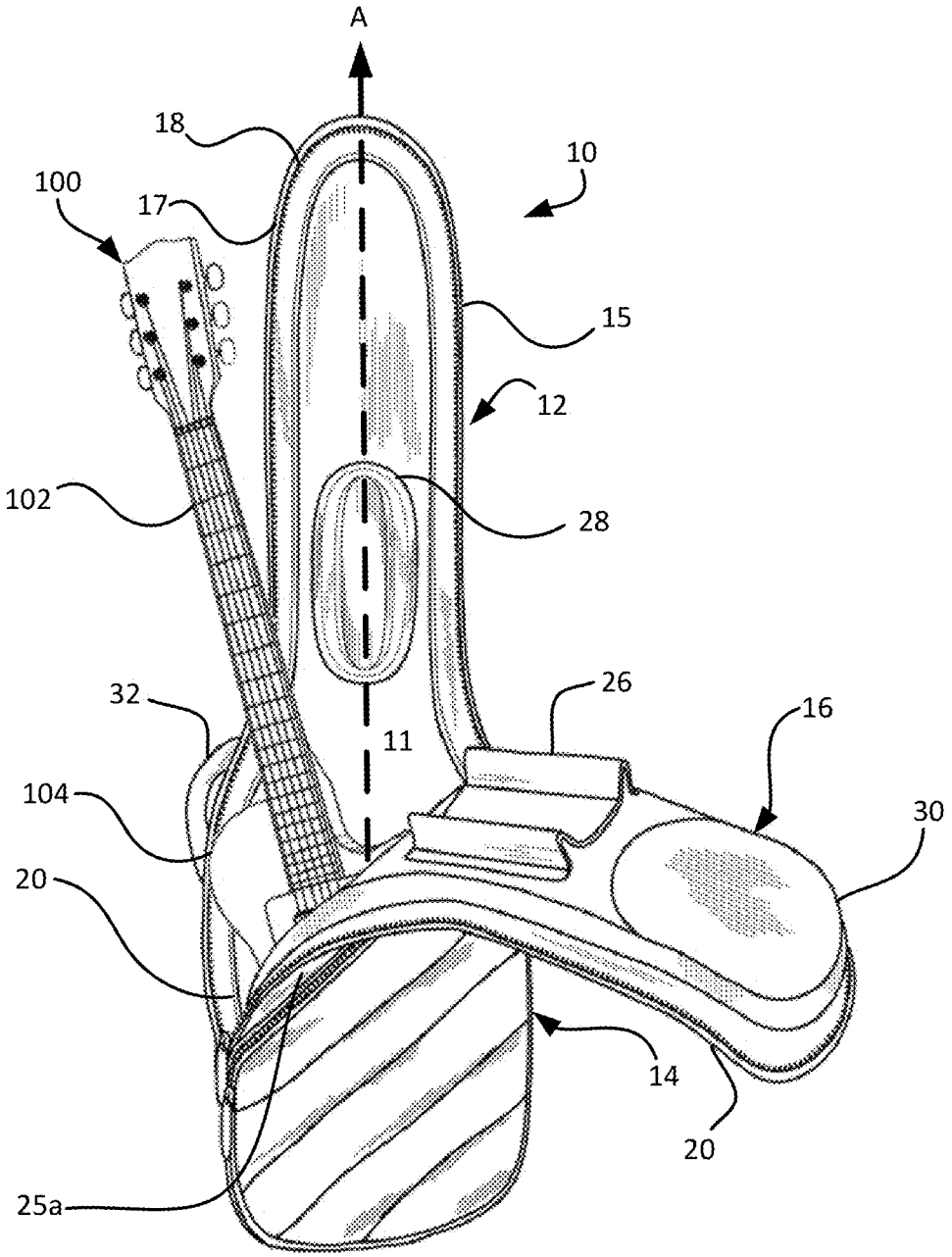
FIG. 2 is a full front elevation view of the protective hybrid case of FIG. 1 with an instrument in the process of being inserted into or being removed from the case.
Figure 3:
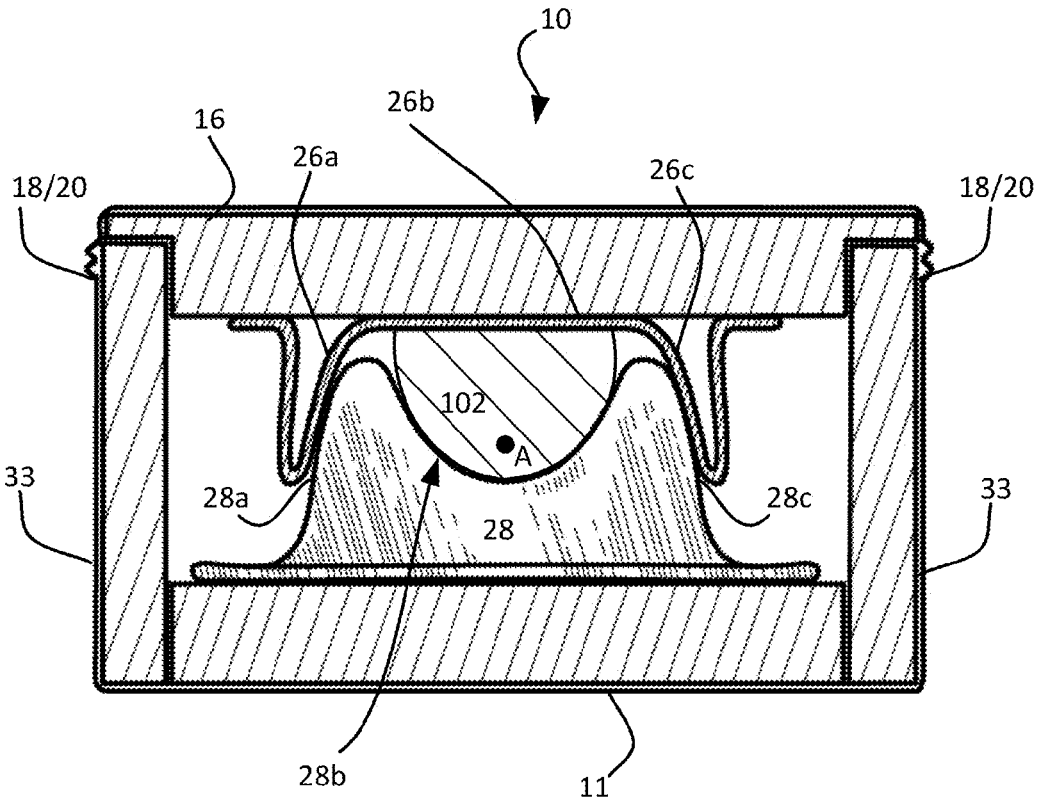
FIG. 3 is a cross-sectional view of the hybrid case of FIGS. 1 and 2 with the section being taken along line S-S of FIG. 1, except that FIG. 3 shows the case of FIGS. 1 and 2 in a closed condition with an instrument having been inserted therein.
Figure 4:
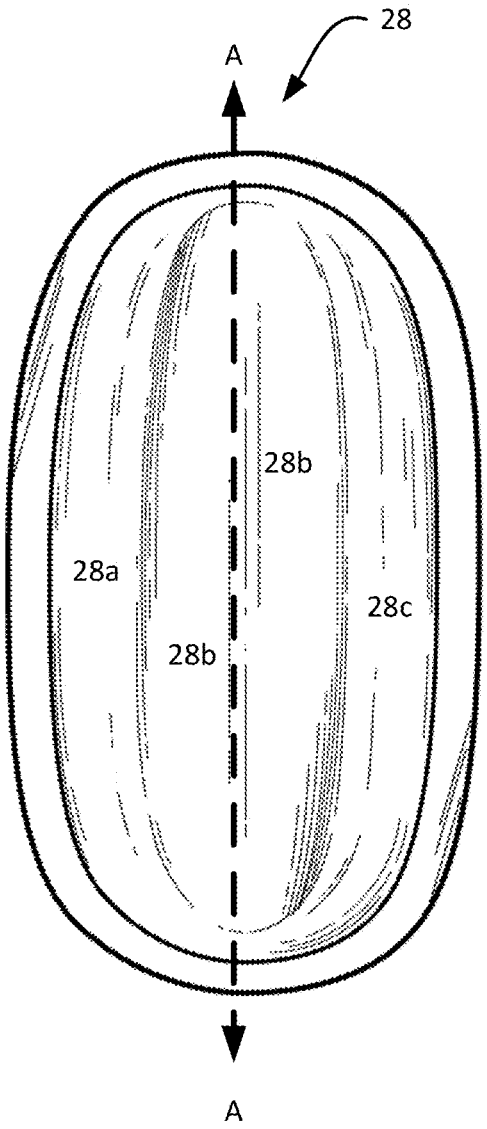
FIG. 4 is a top view of the preferred neck-support shown in FIGS. 1-3.
Figure 5:
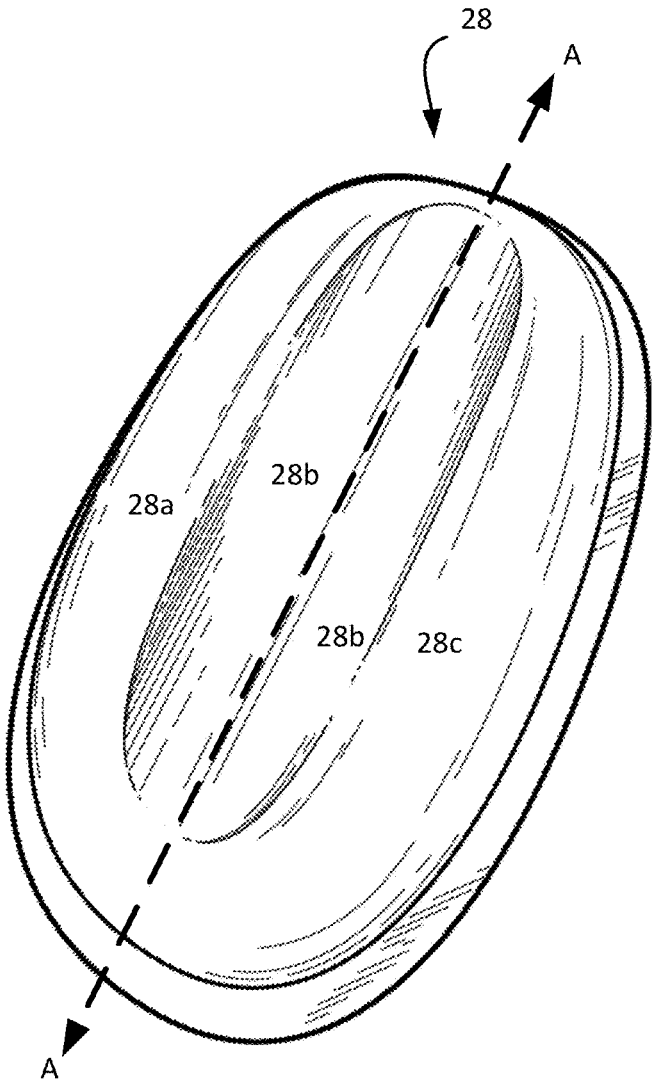
FIG. 5 is a perspective view of the preferred neck-support shown in FIGS. 1-4.
Figure 6:
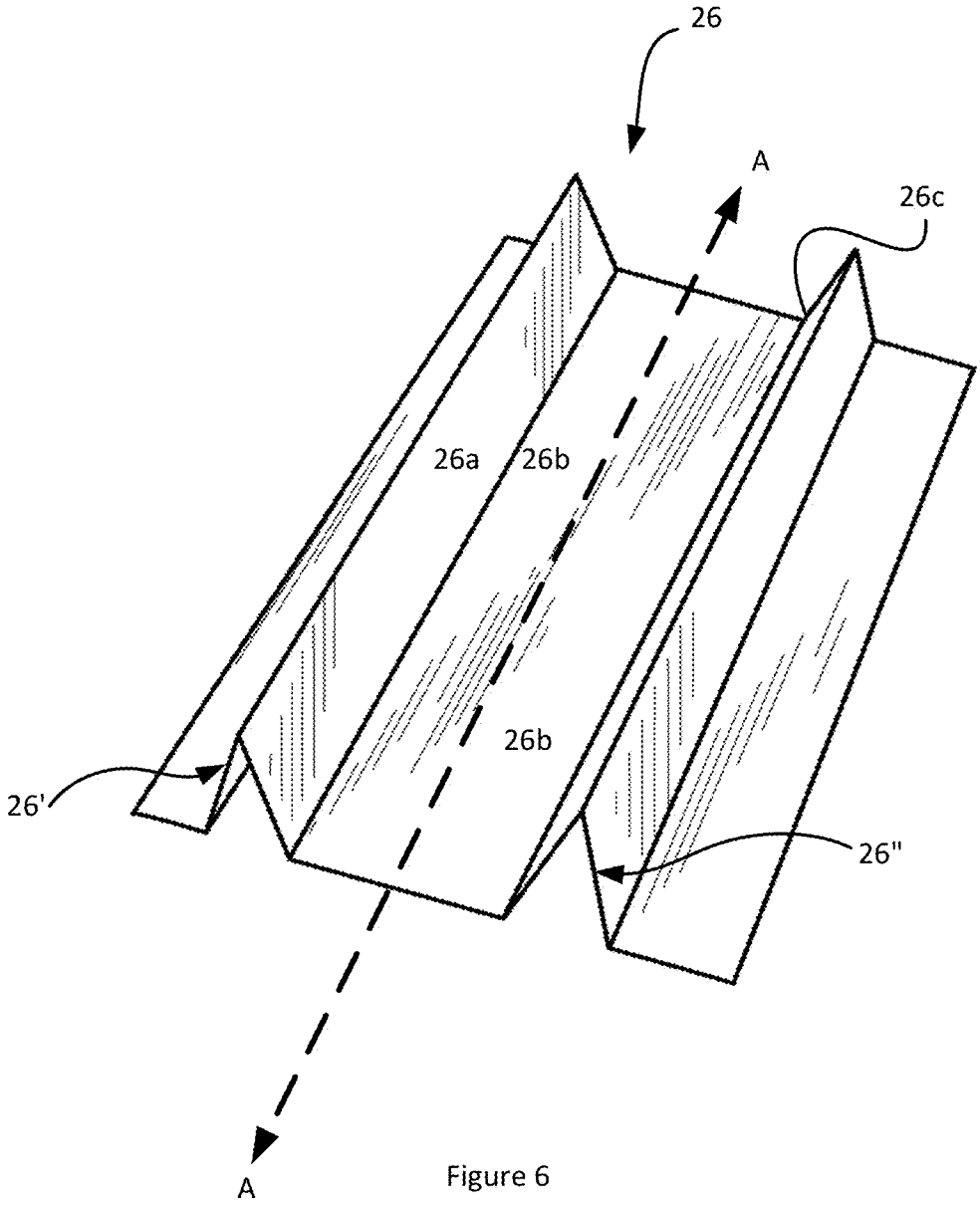
FIG. 6 is a perspective view of the preferred neck-support shown in FIGS. 1-5.

With joint reference to FIG. 1 through FIG. 6, there is shown therein a preferred embodiment of a hybrid protective instrument case 10 of the present invention. By way of example only, the invention is shown and described therein with reference to an electric guitar 100. However, the protective cases according to all of the various Figures can be used not only for guitars but also for holding other musical instruments such as electric, electronic and/or acoustic instruments such as, e.g., double bass, cello, violin, keytar, bass-guitar, ukulele, etc. provided that the dimensions and overall shape are appropriate or modified accordingly. As shown, guitar 100 includes an elongated neck 102 with a head at one free end thereof and affixed to an enlarged body 104 at an upper bout, body 104 also having a lower bout (not shown) at the far bottom end thereof.

As shown, case 10 preferably has a body with upper access 12 and lower enveloping 14 portions for receiving the instrument 100. The body may have a semi-rigid, continuous sidewall defining a continuous front edge 18 with a first elongated side 15 in the upper access portion 12, a second elongated side 17 in the upper access portion 12 (and partially extending into the lower enveloping portion 14), and a bottom portion extending along the lower enveloping portion 14 of the body between the first and second sides 15 and 17. The sidewall 33 further defines a back edge that forms a continuous perimeter, wherein the front and back edges are spaced apart from one another. The case 10 also has a semi-rigid back 11 fixedly attached to the back edge of the sidewall 33. A front cover 16 is releaseably fastened to the sidewall along the first and second elongated sides 15 and 17 and fixedly attached along the bottom portion of the sidewall between the first and second elongated sides. The releasable fastener may be any one or more of a zipper 18 and 20 (preferred), a hook and loop fastener, snap fasteners and many other conventional releasable fasteners known in the art. The front cover 16 further comprises a hinge 25*a* whereby the cover will tend to split open along the hinge 25*a* when the front cover 16 is released from the sidewall 33 and the case is in the upright orientation (as shown in all of the Figures). As can be seen, case 10 preferably includes plural parallel puff pattern seam lines stitched in the cover 16 and back 11. It will be appreciated that the hinge means 25*a* may comprise a weakened diagonal puff pattern seam line extending across the cover 16 between the first and second elongated sides 15 and 17 and located at the far ends of the releasable fastener (zipper 18/20 with draw pulls in the embodiment shown in FIGS. 1 and 2). Alternatively, the cover 16 may be at least partially formed of two pieces of semi-rigid material (within outer fabric of the cover) and the hinge means 25*a* may comprise an interface between adjoining edges of the two pieces of semi-rigid material. More generally, the hinge means 25*a* may comprise an elongated weakened region in the semi-rigid material extending across the cover 16 between the first and second elongated sides 15 and 17.

A conventional handle 32 may be provided as is known in the art. A pad 30 of durable material may be located near the top end of cover 16 to protect the cover from hard and/or sharp components typically found on a stringed instrument (sharp string ends, machine heads, etc.).

It will be appreciated that cases in accordance with the invention may be oriented upright during insertion of and/or removal of instruments. In cases of musical instruments with elongated necks, it naturally follows that the instrument is preferably grasped on the neck when inserting or removing the instrument. This implies that an instrument body will enter an inventive case before an instrument neck. Conversely, an instrument neck will be removed from an inventive case before an instrument body.

With primary reference now to FIGS. 3 through 6, there is shown therein a preferred embodiment of an inventive multi-part neck-brace 26/28 to reliably and firmly secure an intermediate portion of neck 102 of instrument 100 when cover 16 is fastened to the front sidewall edge via zipper 18/20 when closed. Those of ordinary skill will readily appreciate that the inventive principles may be easily extended to neck-braces with more than two-parts.

In one preferred form, the inventive neck-brace 26/28 may include at least a first semi-rigid neck-support 28 with a top surface 28*b* wherein neck-support 28 may be affixed to back 11. It may also have a height equal to or less than the height of sidewall(s) 33 such that top surface 28*b* of first neck-support 28 supports the intermediate region of instrument neck 102 whereby the free end of the neck is suspended between back 11 and cover 16. Neck-brace 26/28 may also have at least a first rigid neck-clamp 26 opposing first neck-support 28 and affixed to cover 16 such that neck 102 is releaseably secured to the top surface 28*b* of first neck-support 28 upon fastening cover 16 to sidewall 33. Significantly, this arrangement dispenses with the need for a neck-brace securing strap (retaining band) as commonly used in the related art.

First neck-support 28 preferably consists essentially of deformable material that conforms to the contour of the instrument neck 102 when cover 16 is releaseably fastened to sidewall(s) 33 and includes elongated recess 28*b* aligned with axis A for that purpose. The first semi-rigid neck-support 28 may be fixedly attached to back 11 of the hybrid case 10 and first rigid neck-clamp 26 may be fixedly attached to cover 16 of case 10. Lesser means of affixation, such as hook and loop fasteners may also be employed to affix these members as is known in the art. As shown best in FIGS. 4, 5 and 6, neck-support 28 may be generally elliptical or oval in shape (top view) and neck-clamp 26 may generally be integrally formed and may include tapered side-members 26' and 26" with a generally flat connective member 26*b* therebetween.

In an alternative embodiment additional neck-braces may be employed instead of simply one. For example, a second neck-brace may be used. If so, this would also require the use of a second semi-rigid neck-support with a top surface, the second neck-support preferably being affixed to the back and having a height equal to or less than the height of the sidewall such that the top surface of the second neck-support supports the intermediate region of the instrument neck whereby the free end of the neck is suspended in the space enclosed between the back and the cover. Moreover, a second rigid neck-clamp may also be used. The second clamp may oppose the second neck-support and may be affixed to the cover such that the instrument neck is releaseably secured to the top surface of the second neck-support upon fastening the cover to the sidewall. These first and second neck-braces may be spaced apart from one another along a line that is at least substantially parallel to the elongated direction of the instrument neck and sized as desired through the exercise of ordinary skill.

Looking at neck-brace 26/28 in further detail, the first preferred semi-rigid neck-support 28 may comprise a unitary body that is elongated along axis A. It may further have a neck-contour-recess 28*b* that is elongated along axis A and that has a pair of inwardly tapered shoulders 28*a* and 28*c* elongated parallel to axis A and on opposites sides of the axis relative to one another. First neck-clamp 26 may be rigid, more rigid than neck-support 28 or semi-rigid and may comprise a pair of outwardly tapered walls 26*a* and 26*c* that are elongated parallel to axis A and on opposites sides of axis A relative to one another. In this way outwardly tapered walls 26*a* and 26*c* mate with inwardly tapered shoulders 28*a* and 28*c* of the neck-support to thereby automatically secure the intermediate region of the instrument neck 102 between the neck-support and the neck-clamp upon fastening cover 16 to the sidewall(s) 33 as shown (and with no other action on the part of the user being necessary). As used herein the terms inwardly tapered and outwardly tapered refer to configurations shown in the drawings. Inwardly/outwardly shoulders/walls may be understood as being on opposite sides of axis A and as either converging toward one another or diverging away from one another, respectively (see especially, FIG. 3). As shown, each of the neck-clamp walls is preferably at least substantially triangular in cross-section perpendicular to the axis A.

The semi-rigid and/or rigid inventive components (neck-support and/or neck-clamp) may be made from various known materials (such as various rubberized plastics, polyolefin, EVA, polyethylene compounds, polyurethane compounds, and other conventional materials in the art) and may be formed using various methods such as through injection molding and/or other conventional methods in the art. The neck-support and/or neck-clamp may be sewn onto the back and cover of the case, respectively. In addition, or alternatively, they may be glued to the back and cover of the case, respectively. Alternatively, the neck-support and/or neck-clamp may be releasably fastened to the back and cover of the case, respectively, using hook and loop fasteners or other known releasable fastener(s).

Those of ordinary skill will readily appreciate that the multi-part neck-brace of the present invention may also be readily applied to hybrid cases designed to accommodate multiple instruments simultaneously (such as those taught in U.S. Pat. No. 7,872,187 issued Jan. 18, 2011 and entitled Hybrid Cases For The Protection Of Up To Two Stringed Musical Instruments). Further, those of ordinary skill will also appreciate that the multi-part neck-brace of the present invention may also be readily applied to hybrid cases designed to open/close in ways other than expressly described with respect to the preferred hybrid case disclosed herein. (such as those taught in U.S. Pat. No. 7,687,701 and issued on Mar. 30, 2010 and entitled Cases For The Protection Of Stringed Musical Instruments). Other examples of related art include U.S. Provisional Patent Application 61/557,896, filed Nov. 9, 2011 and entitled Upright-Access Of Hybrid Cases For Protecting Musical Instruments; and U.S. Provisional Patent Application 61/587,363, filed Jan. 17, 2012 and entitled Upright-Access Of Hybrid Cases For Protecting Musical Instruments; these applications being hereby incorporated by reference in their entirety.

As used herein, "fixedly attached" generally means permanently attached and not intended to be detached and reattached; separating "fixedly attached" components will likely cause damage (such as tearing, ripping, breaking, cutting, etc.) to at least one of the components. Further, as used herein, the terms "fixedly attached" and "releaseably fastened" are intended to be mutually exclusive.

As used herein, "upright orientation" generally means at least generally vertical and/or at least generally perpendicular to a floor/the ground/or similar generally-horizontal surface. With respect to an instrument case, "upright orientation" may additionally mean an orientation in which a far end of the case body may be at least generally adjacent to, on, and/or touching a floor/the ground/or similar generally-horizontal surface. With respect to a stringed instrument, "upright orientation" may mean an orientation in which the instrument neck and headstock are at least generally vertically above the instrument body.

As used herein, "flexible" generally means capable of substantial deformation without a tendency to break and without a natural tendency to return to its original form. Examples of some flexible shell materials include woven cottons, nylon, cordura, vinyl and other natural or synthetic textiles.

As used herein, "semi-rigid" generally means capable of substantial deformation without a tendency to break but with a natural tendency to return to its original form Examples of some semi-rigid materials include polyurethane, high density and "memory" foams, as well as foams layered with other natural or synthetic textiles. Further, as used herein, inflatable components are not "semi-rigid."

As used herein, "rigid" generally means incapable of substantial deformation without a tendency to break and/or with no tendency to return to its original form.

For purposes of the description hereinafter, the terms "upper", "lower", "right", "left", "vertical", "horizontal", "top", "bottom", and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

While the present invention has been described in connection with what is presently considered to be the most practical and preferred embodiments, it is to be understood that the invention is not limited to the disclosed embodiments, but is intended to encompass the various modifications and equivalent arrangements included within the spirit and scope of the appended claims. With respect to the above description, for example, it is to be realized that the optimum dimensional relationships for the parts of the invention, including variations in size, materials, shape, form, function and manner of operation, assembly and use, are deemed readily apparent to one skilled in the art, and all equivalent relationships to those illustrated in the drawings and described in the specification are intended to be encompassed by the appended claims. Therefore, the foregoing is considered to be an illustrative, not exhaustive, description of the principles of the present invention.

What is claimed is:

1. A hybrid protective case for a musical instrument having a contoured neck with a free end at one end, a body attachment region at an opposite end and an intermediate region therebetween, the case comprising:

a semi-rigid back;

a semi-rigid sidewall of a predetermined height extending from the back;

a semi-rigid hinged cover to selectively enclose a region of space between the back, sidewall and cover upon closure of the cover, wherein the cover may be selectively fastened closed with a releasable fastener when the case is in a closed condition; and a multi-part neck-brace comprising one elongated and oval-shaped semi-rigid neck-support with a top surface and inwardly tapered shoulders, the neck-support being affixed to the back and having a height equal to or less than the height of the sidewall such that the top surface of the neck-support supports the intermediate region of the instrument neck whereby the free end of the neck is suspended in the space enclosed between the back and the cover, the multi-part neck-brace further comprising one elongated and linear neck-clamp opposing the neck-support and affixed to the cover such that the instrument neck is automatically secured between the top surface of the neck-support and the neck-clamp upon fastening the cover closed, the-neck-clamp having outwardly sloping walls that mate with the inwardly tapered shoulders of the oval-shaped neck-support upon fastening the cover closed, and no neck retaining band to secure the neck to the top surface of the oval-shaped neck-support.

2. The hybrid case of claim 1, wherein the multi-part neck-brace consists essentially of one elongated and oval-shaped semi-rigid neck-support with inwardly tapered shoulders and one elongated and linear neck-clamp with outwardly sloping walls that mate with the inwardly tapered shoulders of the oval-shaped neck-support upon fastening the cover closed.

3. The hybrid case of claim 1, wherein the multi-part neck-brace consists of one elongated and oval-shaped semi-rigid neck support with inwardly tapered shoulders and one elongated and linear neck-clamp with outwardly sloping walls that mate with the inwardly tapered shoulders of the oval-shaped neck-support upon fastening the cover closed.

4. The hybrid case of claim 1, wherein the neck-support consists essentially of deformable material that conforms to the contour of the instrument neck and the neck-clamp is formed of material that is more rigid than the semi-rigid material from which the neck-support is formed.

5. The hybrid case of claim 1, wherein the semi-rigid neck-support is fixedly attached to the back of the hybrid case, the neck-clamp is formed of rigid material, and the neck-clamp is fixedly attached to an interior surface of the case cover.

6. The hybrid case of claim 1, wherein each of the neck-clamp walls is at least substantially triangular in cross-section perpendicular to the axis.

7. The hybrid case of claim 1, wherein the semi-rigid neck-support consists essentially of an oval-shaped body that is elongated along an axis, that has a neck-contour-recess that is elongated along the axis and that has a pair of converging shoulders that are elongated parallel to and on opposites sides of the axis relative to one another; and the neck-clamp comprises a pair of linear and diverging rigid walls that are elongated parallel to and on opposites sides of the axis relative to one another such that the diverging rigid walls mate with the converging shoulders of the neck-support to thereby secure the intermediate region of the instrument neck between the elongated neck-support and the elongated neck-clamp upon fastening the cover.

8. A hybrid case for the protection of at least one musical instrument with an elongated neck and a body in which insertion of and removal of the musical instrument occurs with the case in an upright orientation on a surface, the case comprising:

a semi-rigid body having an elongated upper access portion for receiving the instrument neck and a lower enveloping portion for receiving the instrument body, wherein a far end of the lower enveloping portion rests on the surface with the case in the upright orientation, and wherein the upper access portion of the body comprises a semi-rigid back, at least one semi-rigid sidewall, and a semi-rigid cover hingedly attached to the case body to thereby permit the musical instrument to be inserted into and removed from the case through the upper access portion with the case in the upright orientation on the surface; and a multi-part neck-brace consisting essentially of one elongated and oval-shaped semi-rigid neck support with a top surface and inwardly tapered shoulders, the neck-support being affixed to the semi-rigid back and having a height equal to or less than the height of the at least one semi-rigid sidewall such that the top surface of the first neck-support supports the instrument neck the multi-part neck-brace further consisting essentially of one elongated and linear neck-clamp opposing the first neck-support and affixed to the cover such that the instrument neck is automatically secured between the top surface of the first neck-support and the neck-clamp upon fastening the cover closed, the neck-clamp having outwardly sloping walls that automatically mate with the inwardly tapered shoulders of the oval-shaped neck-support upon fastening the cover closed.

9. The hybrid case of claim 8, wherein each of the neck-clamp walls is at least substantially triangular in cross-section perpendicular to the axis.

10. The hybrid case of claim 8, wherein the neck-clamp automatically mates with the neck-support upon fastening the cover closed.

11. The hybrid case of claim 8, wherein the neck-support consists essentially of deformable material that conforms to the contour of the instrument neck and the neck-clamp is formed of material that is more rigid than the semi-rigid material from which the neck-support is formed.

12. The hybrid case of claim 8, wherein the semi-rigid neck-support is fixedly attached to the back of the hybrid case, the neck-clamp is formed of rigid material, and the neck-clamp is fixedly attached to an interior surface of the case cover.

13. A hybrid case for the protection of at least one musical instrument with an elongated neck and a body in which insertion of and removal of the musical instrument occurs with the case in an upright orientation on a surface, the case comprising:

a semi-rigid body having an elongated upper access portion for receiving the instrument neck and a lower enveloping portion for receiving the instrument body, wherein a far end of the lower enveloping portion rests on the surface with the case in the upright orientation, and wherein the upper access portion of the body comprises a semi-rigid back, at least one semi-rigid sidewall, and a semi-rigid cover hingedly attached to the case body to thereby permit the musical instrument to be inserted into and removed from the case through the upper access portion with the case in the upright orientation on the surface; and a multi-part neck-brace comprising:

one elongated and oval-shaped semi-rigid neck-support with a top surface and inwardly tapered shoulders, the neck-support being affixed to the semi-rigid back and having a height equal to or less than the height of the at least one semi-rigid sidewall such that the top surface of the first neck-support supports the instrument neck;

one elongated and linear neck-clamp opposing the first neck-support and affixed to the cover, the neck clamp having outwardly sloping walls that mate with the inwardly tapered shoulders of the neck-support upon fastening the cover closed such that the instrument neck is automatically secured between the top surface of the neck-support and the neck-clamp upon fastening the cover closed, wherein each of the neck-clamp walls is at least substantially triangular in cross-section perpendicular to the axis; and no neck retaining band to secure the neck to the top surface of the oval-shaped neck-support.

* * * * *